US006189718B1

(12) United States Patent
Morrison

(10) Patent No.: US 6,189,718 B1
(45) Date of Patent: Feb. 20, 2001

(54) FLUIDTIGHT SEAL FOR A CONTAINER

(75) Inventor: Edward F. Morrison, Burnt Hills, NY (US)

(73) Assignee: The United States of America as represented by the Department of Energy, Washington, DC (US)

( * ) Notice: Under 35 U.S.C. 154(b), the term of this patent shall be extended for 0 days.

(21) Appl. No.: 09/281,955

(22) Filed: Mar. 31, 1999

(51) Int. Cl.[7] ..... B65D 53/00

(52) U.S. Cl. ..... 220/233; 220/234; 220/235; 220/237

(58) Field of Search ..... 220/233, 234, 220/235, 236, 237, 238, 378, 327, 328; 215/360, 362

(56) References Cited

U.S. PATENT DOCUMENTS 3,307,732 * 3/1967 Roberts, Sr. et al. ..... 220/233
4,140,040 * 2/1979 Modrey ..... 220/327
4,239,124 * 12/1980 Inouye ..... 220/328
4,380,302 * 4/1983 Broad ..... 220/235
5,078,294 * 1/1992 Staubli ..... 220/233
5,230,437 * 7/1993 Kelly ..... 220/237
5,307,841 * 5/1994 Condon ..... 220/237

* cited by examiner

*Primary Examiner*—Nathan J. Newhouse
(74) *Attorney, Agent, or Firm*—John T. Lucas; William R. Moser; Paul A. Gottlieb

(57) ABSTRACT

A fluidtight seal for a container is formed by abutting a metal ring with a step machined in a convexo-concave container closure device and inserting this assembly into an open end of the container. Under compressive force, the closure device deforms causing the metal ring to pivot about the step on the closure device and interact with symmetrically tapered inner walls of the container to form a fluidtight seal between the container and the closure device. The compressive force is then withdrawn without affecting the fluidtight characteristic of the seal. A destructive force against the container closure device is necessary to destroy the fluidtight seal.

18 Claims, 3 Drawing Sheets

FLUIDTIGHT SEAL FOR A CONTAINER

BACKGROUND OF THE INVENTION

1. Field of the Invention

The present invention relates generally to a fluidtight seal for a container and, in particular, to a permanent, fluidtight seal formed through a compressive force. The compressive force deforms a container closure device causing a seal to interact with the container closure device and inner walls of the container in a fluidtight manner. The compressive force is then removed and the fluidtight seal is maintained until a destructive force is applied to the container closure device.

2. Description of the Related Art

Seals of various configurations and materials are well known in the art for sealing a container in a fluidtight manner. There are basically two known ways that these variously configured seals interact with the container to form a fluidtight barrier. The first way a seal is maintained in a fluidtight manner is through the force of the contained fluid forcing the seal into fluidtight interaction with the container. This type of fluidtight seal is disclosed in U.S. Pat. Nos. 4,421,325 to Napolitano, 5,092,496 to Gayle et al. and 4,457,523 to Halling et al. The second way a seal is maintained in a fluidtight manner relies on the continued application of an external compressive force such as through the use of bolts or other fasteners. This type of fluidtight seal is disclosed in U.S. Pat. Nos. 3,332,573 to Romanos and 4,991,858 to Abila et al. Both of the aforementioned seal designs require a continual force or pressure to maintain seal integrity. Thus the utility of these seals is limited to applications in which forces necessary to close the sealing surfaces properly need to be continually applied to maintain liquid tightness.

What is needed is a watertight seal that may be maintained without the need for compression, pressure, or the like from an external force once the seal has been made. Such a watertight seal would have many advantages over the previous designs, including the elimination of the weight, physical bulk and costs associated with the materials, such as nuts, bolts, plugs, and fittings, used to create the external force necessary to maintain seal compression.

SUMMARY OF THE INVENTION

It is therefore a principal object of the present invention to provide a fluidtight seal for a container which is readily and inexpensively manufactured, reliable and easily used.

It is an object of the present invention to provide a fluidtight seal which has uses in many industries, such as the waste disposal industry.

It is an object of the present invention to form a fluidtight seal through application of a compressive force, which may be removed once the seal is formed.

It is a further object of the present invention to provide a fluidtight seal that is not compromised by the withdrawal of the compressive force used to form the seal.

It is a further object of the present invention to provide a permanent fluidtight seal in which the fluidtight characteristic of the seal can only be disrupted by the application of a destructive force.

The foregoing and other objects of the present invention are realized by forming a fluidtight seal for a container by abutting a metal ring against a step machined convexo-concave container closure device and inserting this assembly into an open end of the container. Through the application of compressive force, the container closure device is deformed, causing the metal ring to pivot about the step on the container closure device and interact with the symmetrically tapered inner walls of the container to form a fluidtight seal between the container and the container closure device. The compressive force is then withdrawn without affecting the fluidtight characteristic of the seal. A destructive force against the container closure device is necessary to destroy the fluidtight seal.

Thus, the present invention provides a fluidtight seal which advantageously allows for the permanent, fluidtight sealing of a container without the need for continuous, external compression force.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings, all of which form a part of this specification, wherein like reference numerals designate corresponding parts in the various figures.

BRIEF DESCRIPTION OF THE DRAWINGS

These and other objects, advantages and novel features of the present invention will become apparent from the following detailed description taken in consideration of the accompanying drawings, in which:

FIG. 2 is an exploded view of a fluidtight container in accordance with this invention, wherein;

DETAILED DESCRIPTION OF THE INVENTION

Figure 1:
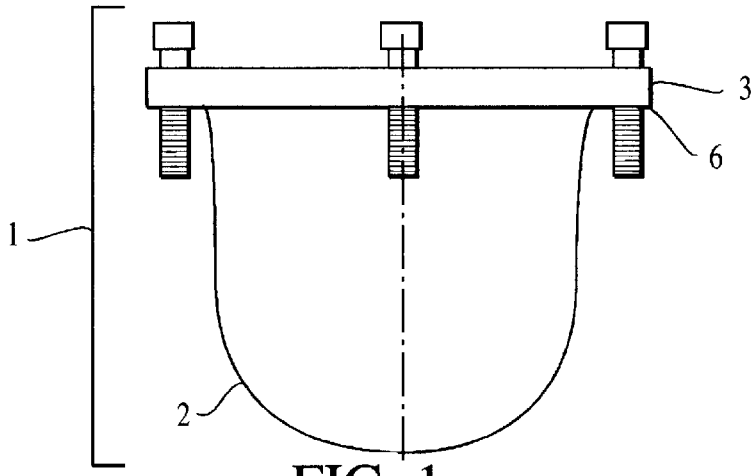
FIG. 1 is a side view of a compressive device in accordance with this invention.

FIGS. 1–2 illustrate the general structure for a compressive device and container assembly that may incorporate the novel sealing arrangement of the present invention. As shown therein in FIG. 1, a compressive device 1 is of any suitable shape and size but preferably in the form of a convexo-concave device, with a contact portion 2 on the convex surface of the convexo-concave device and having a flange 3 disposed around the periphery of the convexo-concave device. Fasteners 4, such as threaded bolts, are disposed at spaced intervals through fastener openings 6 in the flange 3 for attaching the compressive device 1 to the container assembly and for applying the compressive force necessary to provide the fluidtight seal.

Figure 2A:
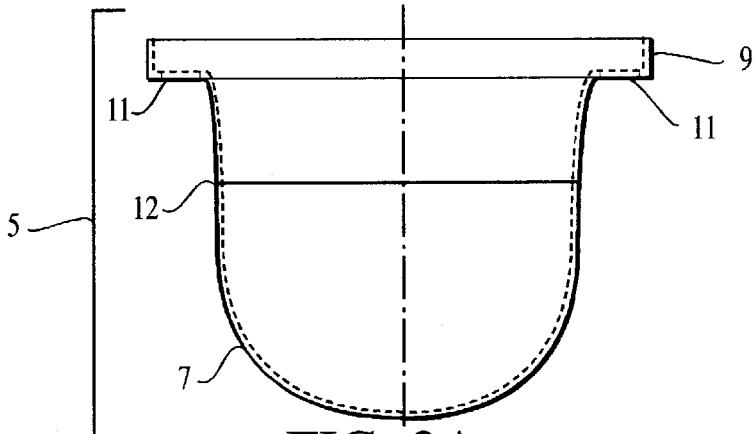
FIG. 2A is a side view of a container closure device in accordance with this invention.
Figure 2B:
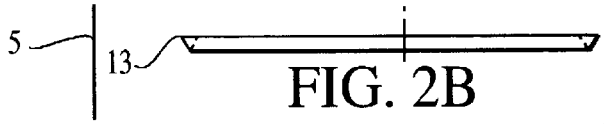
FIG. 2B is a side view of a seal in accordance with this invention.
Figure 2C:
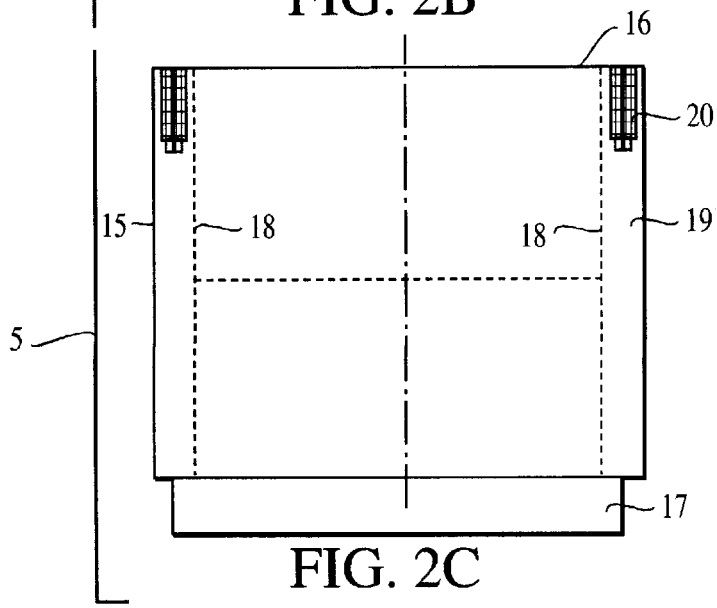
FIG. 2C is a side view of a container in accordance with this invention.

FIG. 2 shows an exploded view of the container assembly 5. As shown in FIG. 2A, the container assembly 5 includes a container closure device 7 of any shape and size complementary to the surface 2 of the compressive device 1, but preferably in the form of a convexo-concave device, with a flange 9 disposed around the opening of the concave surface and with fastener openings 11 disposed at spaced intervals through the flange 9 for fasteners 4 to pass. A step 12 is machined about the convex surface of the container closure device. As shown in FIG. 2B, the container assembly 5 includes a ring 13 of any shape and size complementary to the container closure device 7 and the surface 2 of the compressive device 1, but preferably in a circular form and having a triangular cross-section. When the container assembly is assembled, the ring 13 seats on the step 12 machined on the surface of the container closure device 7. As shown in FIG. 2C, the container assembly 5 includes a container 15 for the storage of fluids, for example, hazardous waste, of any shape and size complementary to the container closure device 7, the surface 2 of the compressive device 1 and the ring 13, but preferably in a cylindrical form. The cylindrical container 15 has an open end 16 at one end of the container and an end wall 17 sealing the other end of the container. Threaded fastener receptacles 20 are disposed in the container walls 19 about the periphery of the open end 16 to receive fasteners 4. The inner surfaces 18 of the container walls are inwardly tapered beginning at the open end 16 and proceeding toward the end wall 17.

Figure 3:
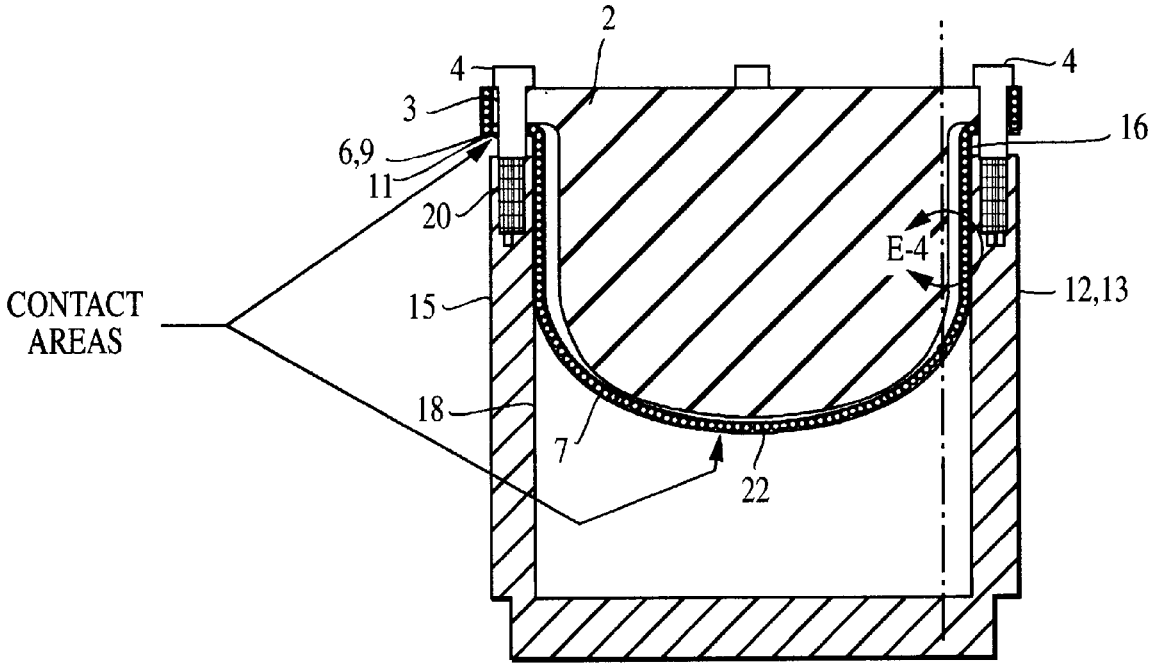
FIG. 3 is a cross-sectional view of the assembled items of FIGS. 1 and 2.

FIG. 3 is a cross-sectional view of the assembled items of FIGS. 1 and 2. Ring 13 is seated on the step 12 of the convex surface of the container closure device 7. Container closure device 7 is inserted into the open end 16 of the container 15 so that the ring 13 and step 12 are within the container 15 and the fastener openings 11 are aligned with the threaded fastener receptacles 20. The concave surface 2 of the compressive device 1 is then inserted into the concave surface of the container closure device 7 and the fasteners 4 are inserted through the fastener openings 6 and 9 and fastened into the threaded fastener receptacles 20 until the concave surface 2 of the compressive device 1 makes initial contact with the container closure device 7 at region 22.

Figure 4:
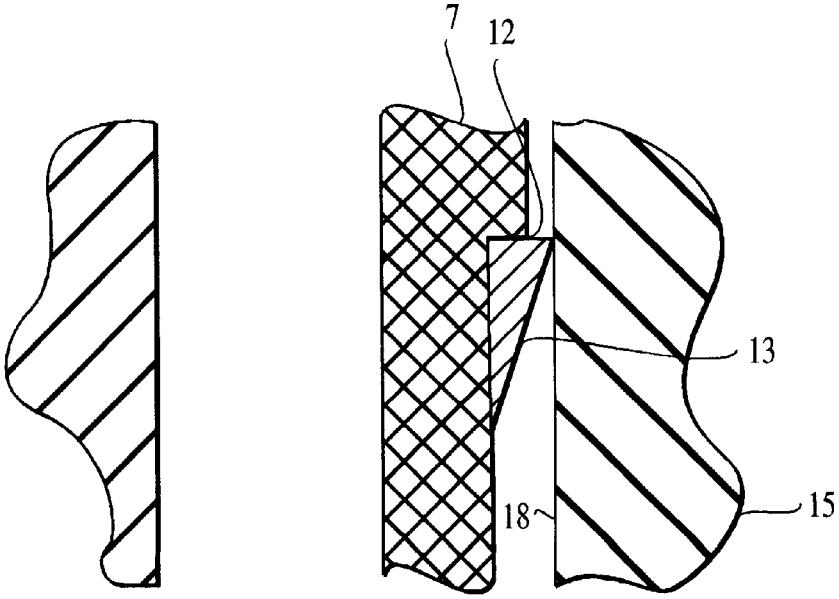
FIG. 4 is an enlarged view of a portion of the seal prior to the application of compressive force as shown in FIG. 3.

FIG. 4 is an enlarged view of a portion of the seal prior to the application of compressive force as shown in FIG. 3. Ring 13 is seated on step 12 in such a manner that the ring 13 makes contact with both the container closure device 7 and the inwardly tapering inner surfaces 18 of the container 15.

Figure 5:
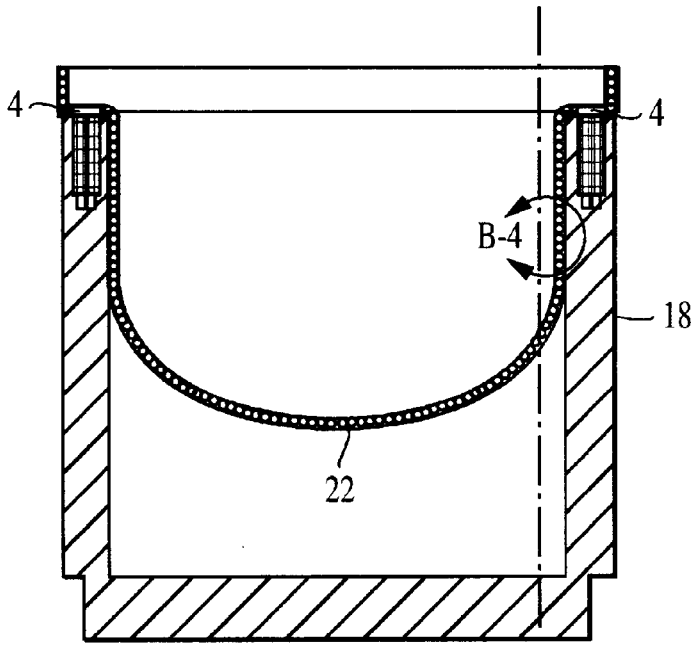
FIG. 5 is a cross-sectional view of the assembled items of FIG. 2 after the application and withdrawal of the compressive device.

FIG. 5 is a cross-sectional view of the assembled items of FIG. 2 after the application of compressive force and the withdrawal of the compressive device. To apply the compressive force the fasteners 4 are tightened causing the concave surface 2 of the compressive device 1 to make contact with the container closure device 7 at region 22 and then further tightened to cause permanent deformation of the container closure device 7 which in turn causes the ring 13 to engage the inner surface 18 of the container in a fluidtight manner.

Figure 6:
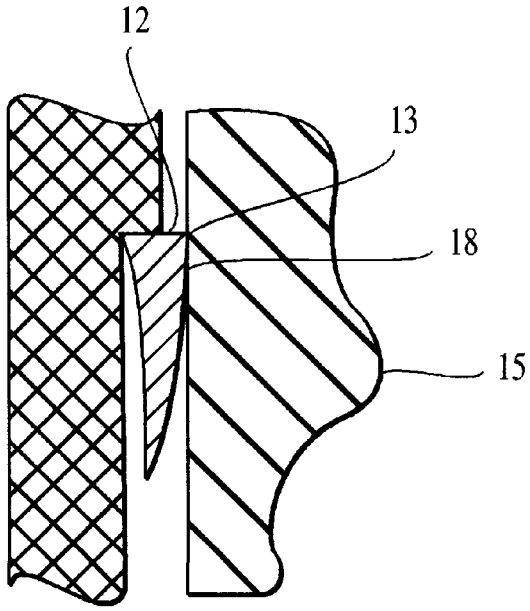
FIG. 6 is an enlarged view of a portion of the seal after application and withdrawal of the compressive device as shown in FIG. 5.

FIG. 6 is an enlarged view of a portion of the seal 13 after the application of compressive force and the withdrawal of the compressive device 1 as shown in FIG. 5. The application of compressive force and the resulting permanent deformation of the container closure device 7 has forced the ring 13 to pivot around the step 12 and engage the inner surfaces 18 of the container 15 in a fluidtight manner until such time as a destructive force is applied to the container closure device 7.

While this invention has been described as having a preferred design, it is understood that it is capable of further modification, uses and/or adaptations following in general the principle of the invention and including such departures from the present disclosure as come within known or customary practice in the art to which the invention pertains.

What is claimed is:

1. An assembly for sealing a container in a fluidtight manner, comprising:

a) means for closing said container, said container closure means operably associated with said container;

b) means for fluidtight sealing of said container operably associated with said container closure means;

c) removable means for compression adapted to interact with said container closure means, wherein said compression means interacts with said container closure means to cause said sealing means to contact said container closure means and said container to form a fluidtight seal, and wherein said means for compression may be removed without compromising the fluidtight seal.

2. The assembly as recited in claim 1, wherein a) said container has an inner surface, and;

b) said container closure means has a first and second surface.

3. The assembly as recited in claim 2, wherein said compression means interacts with said second surface of said container closure means to cause said sealing means to contact said inner surface said container and said first surface of said container closure means in a fluidtight manner.

4. The assembly as recited in claim 2, wherein:

a) said first surface includes a step, and;

b) said sealing means seats upon said step.

5. The assembly as recited in claim 4, wherein said sealing means is generally ring-shaped and has a cross-section generally configured as a triangle.

6. The assembly as recited in claim 4, wherein said inner surface of said container is tapered.

7. The assembly as recited in claim 4, wherein said compression means interacts with said second surface of said container closure means to cause said sealing means to pivot about said step and contact said inner surface of said container and said first surface of said container closure means in a fluidtight manner.

8. The assembly as recited in claim 5, wherein said comrpression means interacts with said second surface of said container closure means to cause said sealing means to pivot about said step and contact said inner surface of said container and said first surface of said container closure means in a fluidtight manner.

9. The assembly as recited in claim 6, wherein said compression means interacts with said second surface of said container closure means to cause said sealing means to pivot about said step and contact said inner surface of said container and said first surface of said container closure means in a fluidtight manner.

10. The assembly as recited in claim 9, wherein said container closure means is constructed a soft metal.

11. The assembly as recited in claim 9, wherein said sealing means continues to contact said container means and said container closure means in a fluidtight manner after the compression means is withdrawn.

12. The assembly as recited in claim 9, wherein said sealing means continues to contact said container means and said container closure means in a fluidtight manner until a destructive force is applied to the container closure means.

13. A method for sealing a container in a fluidtight manner which comprises the steps of:

a) placing a sealing device on a container closure device to form a sealing assembly;

b) inserting said sealing assembly into a container wherein a first surface, of said sealing assembly and an inner surface of said container are in proximity about a periphery of said container closure device defined by said first surface;

c) compressing a compression device into a second surface of said sealing assembly until said sealing device interacts with said inner surface of said container and with said first surface of said container closure device to form a fluidtight seal on said container; and, d) withdrawing said compression device from said second surface of said closure device without disrupting the fiuidtight seal.

14. A method in accordance with claim 13 wherein the step of compressing comprises a pivoting of said sealing device about a step on said first surface of said container closure device and an abutting of the sealing device against said inner surface of said container and against said step.

15. A method in accordance with claim 13 wherein said sealing device comprises a metal ring.

16. A method in accordance with claim 15 wherein a cross section of the sealing device is generally configured as a triangle.

17. A method in accordance with claim 16 wherein said first surface of said container closure means is configured with a step.

18. A method in accordance with claim 17 wherein the step of compressing comprises a pivoting of said sealing device about said step on said first surface of said container closure device and an abutting of the sealing device against said inner surface of said container and against said step.

* * * * *